US006086068A

United States Patent [19]

Ayres et al.

[11] Patent Number: 6,086,068

[45] Date of Patent: Jul. 11, 2000

[54] ROACH COACH BOARD GAME

[76] Inventors: Joseph M. Ayres; Terri L. Ayres, both of 312 Hunter St., Gloucester City, N.J. 08030

[21] Appl. No.: 09/267,091

[22] Filed: Mar. 12, 1999

[51] Int. Cl.[7] ..... A63F 3/00

[52] U.S. Cl. ..... 273/236; 273/242; 273/243; 273/150; 273/429

[58] Field of Search ..... 273/236, 242, 273/243, 287, 288

[56] References Cited

U.S. PATENT DOCUMENTS

| | | |
|---|---|---|
| 1,530,213 | 3/1925 | Squire . |
| 1,635,734 | 7/1927 | Ziegler . |
| 3,623,263 | 11/1971 | Frampton . |
| 4,090,717 | 5/1978 | Rossetti . |
| 4,214,755 | 7/1980 | Wysocki . |
| 4,279,422 | 7/1981 | Shaw . |
| 4,907,807 | 3/1990 | Lee . |
| 5,055,084 | 10/1991 | Jokic . |
| 5,104,127 | 4/1992 | Whitney . |
| 5,120,263 | 6/1992 | Ierfino . |
| 5,342,058 | 8/1994 | Giovannetti . |
| 5,360,216 | 11/1994 | Counterman . |
| 5,435,565 | 7/1995 | Benaderet . |
| 5,445,389 | 8/1995 | Jeffreyes, Jr. . |
| 5,451,061 | 9/1995 | DeLessio . |

*Primary Examiner*—Jeanette Chapman
*Assistant Examiner*—Vishu Mendiratta
*Attorney, Agent, or Firm*—Henderson & Sturm LLP

[57] ABSTRACT

A board game to be played by two or more players. The game board includes an outer ring of situation spaces and an inner ring of situation spaces with access from the outer ring to the inner ring being provided at one corner situation space. Player game pieces of contrasting colors are made in the shape of a house, and game dice are used to determine the order of play and the movement of the player game pieces. Two stacks of situation cards are provided: the roach cards indicate the type of roaches that infest the player house, and action cards indicate what actions that can or cannot be taken to dispose of the roaches. A roach coach is moved to the position of the players when it is their turn. The coach has a hinged roof that supports the two stacks of situation cards, and a hinged spring biased platform that ejects roaches from the coach onto the game board when a player draws a specified roach card.

1 Claim, 6 Drawing Sheets

ROACH COACH BOARD GAME

BACKGROUND OF THE INVENTION

1. Field of the Invention

This invention relates to the field of board games, and more particularly to a board game having a unique coach for moving game cards to the respective players.

2. Description of the Related Art

As can be seen by reference to the following U.S. Pat. Nos. 5,104,127; 5,342,058; 5,360,216; 5,435,565; and 5,445,389, the prior art is replete with myriad and diverse board games.

While all of the aforementioned prior art games are more than adequate for the basic purpose for which they have been specifically designed, they are uniformly deficient with respect to their failure to provide a simple, exciting and entertaining board game having an interactive game piece holder.

As a consequence of the foregoing situation, there has existed a need for a new and improved board game and the provision of such a device is stated objective of the present invention.

BRIEF SUMMARY OF THE INVENTION

Briefly stated, the present invention provides a board game to be played by two or more players. The game board includes an outer ring of situation spaces and an inner ring of situation spaces with access from the outer ring to the inner ring being provided at one corner situation space. Player game pieces of contrasting colors are made in the shape of a house, and game dice are used to determine the order of play and the movement of the player game pieces. Two stacks of situation cards are provided: the roach cards indicate the type of roaches that infest the player house, and action cards indicate that actions what can or cannot be taken to dispose of the roaches. A roach coach is moved to the position of the players when it is their turn. The coach has a hinged roof that supports the two stacks of situation cards, and a hinged spring biased platform that ejects roaches from the coach onto the game board when a player draws a specified roach card.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
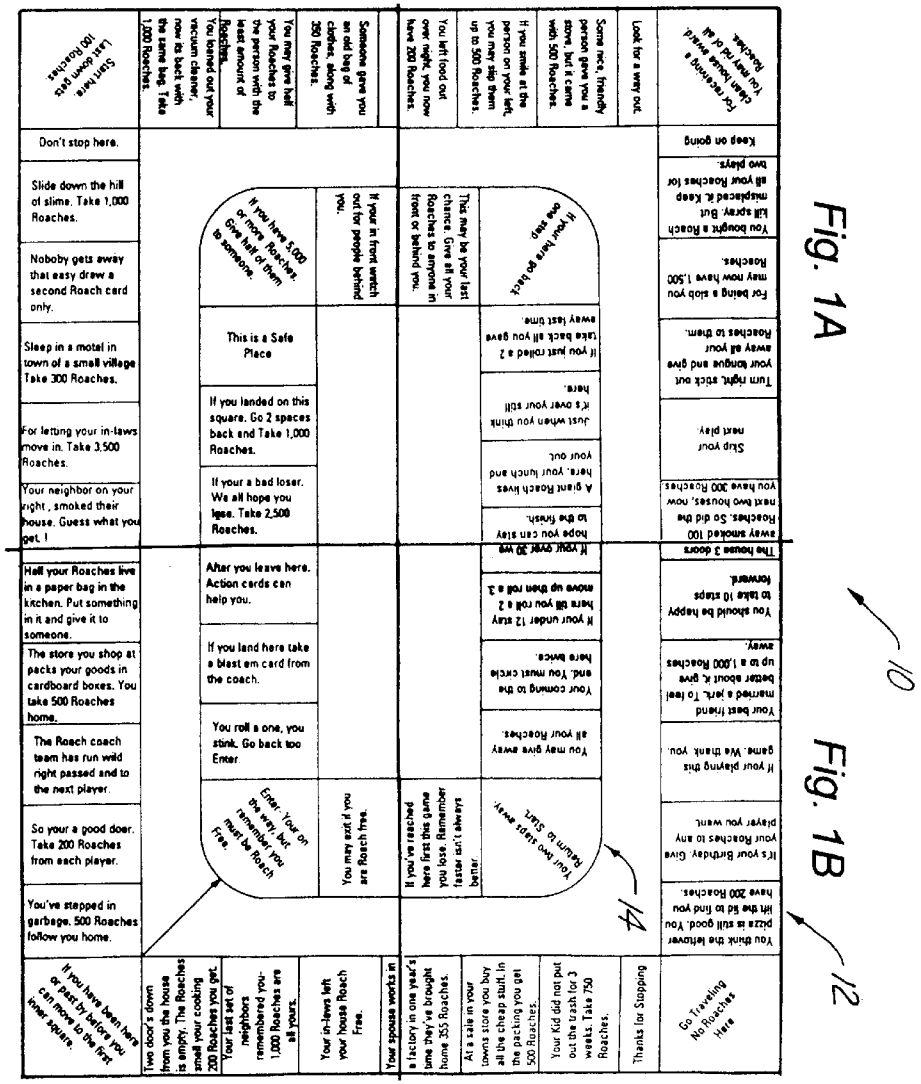
FIG. 1 is a top plan view of the game board used in the game of the present invention, this is a composite of FIGS. 1A, 1B, 1C and 1D.
Figure 1A:
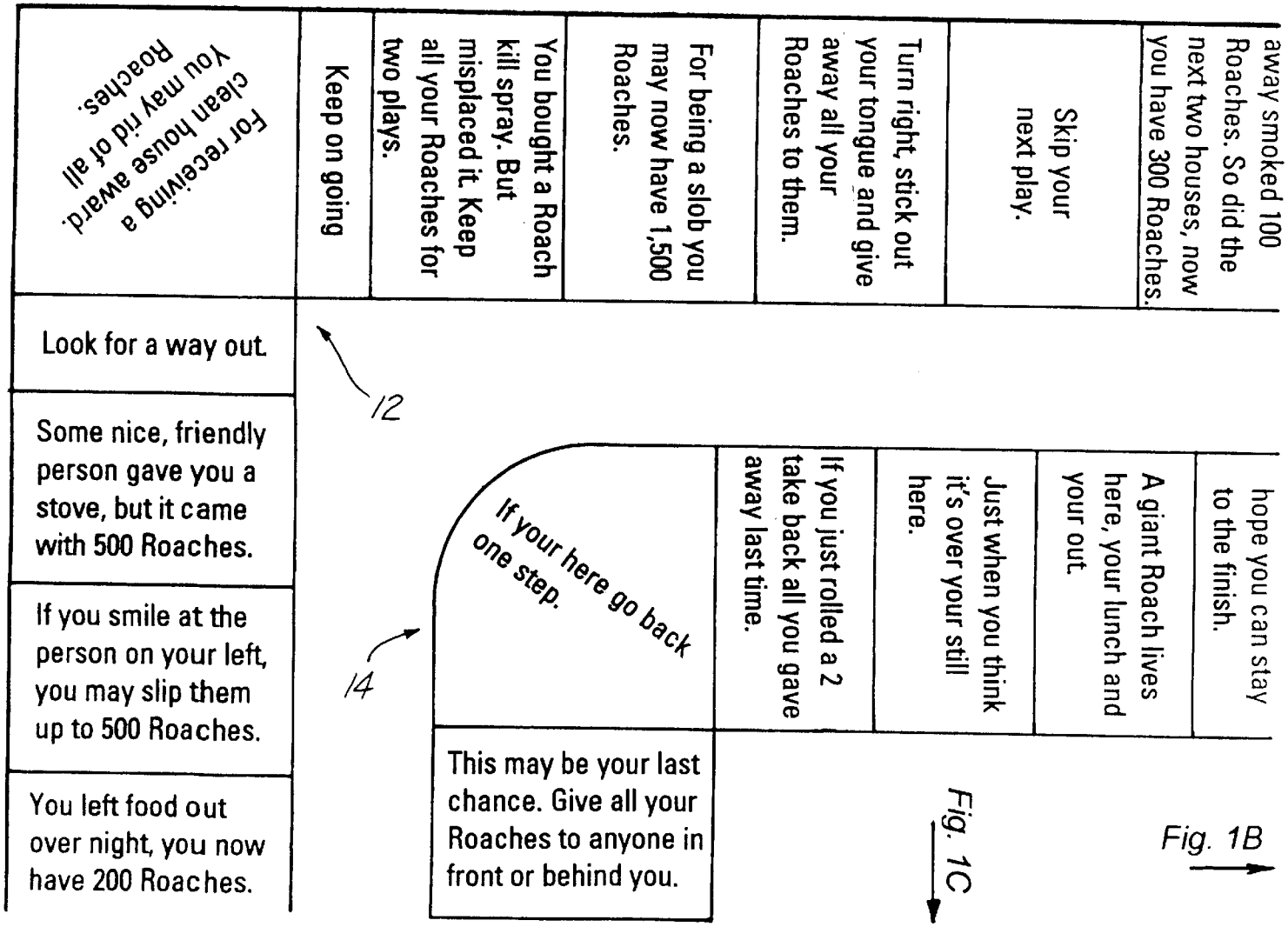
FIG. 1A is a top plan view of the upper left quadrant of the game board shown in FIG. 1.
Figure 1B:
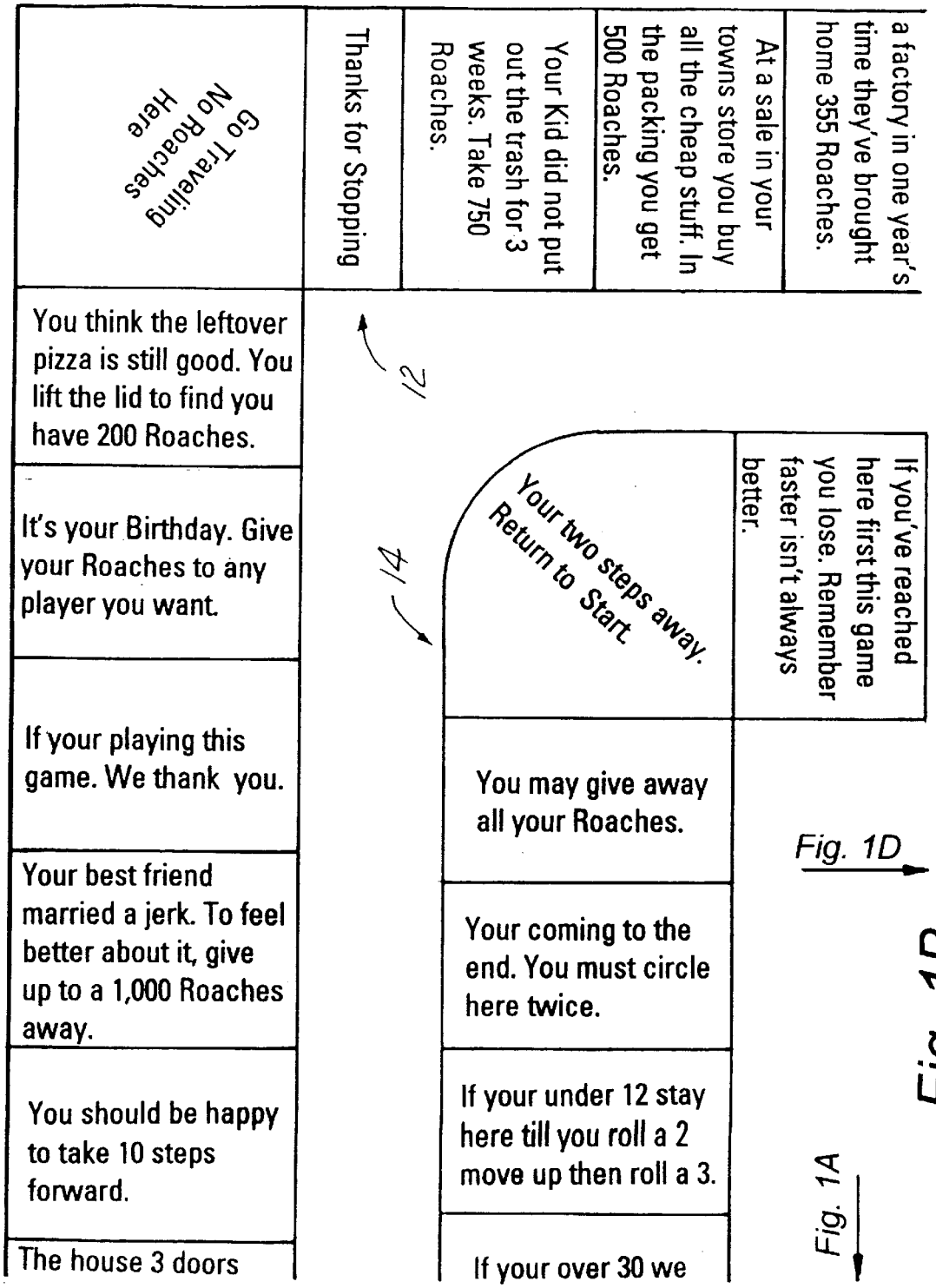
FIG. 1B is a top plan view of the upper right quadrant of the game board shown in FIG. 1.
Figure 1C:
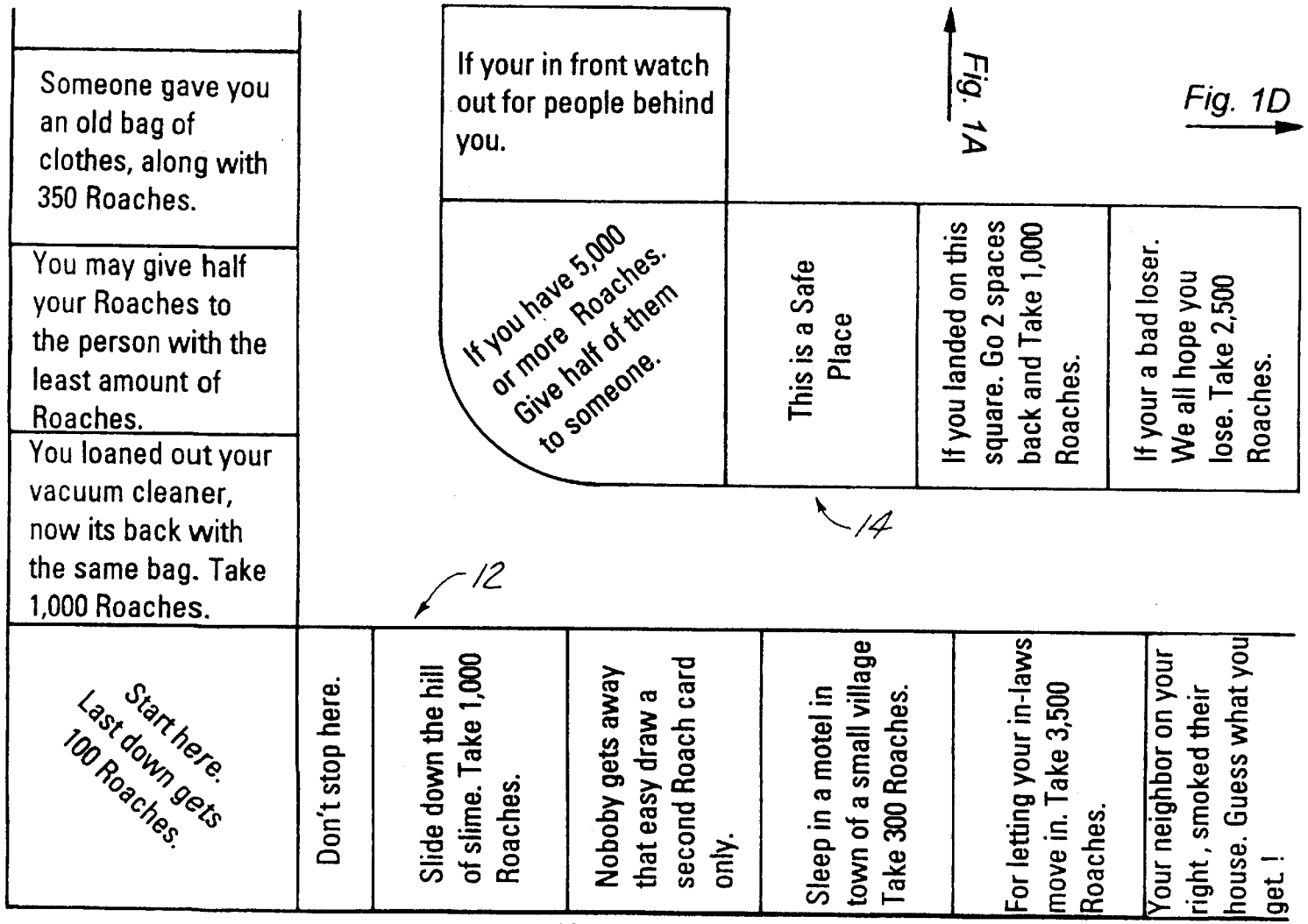
FIG. 1C is a top plan view of the lower left quadrant of the game board shown in FIG. 1.
Figure 1D:
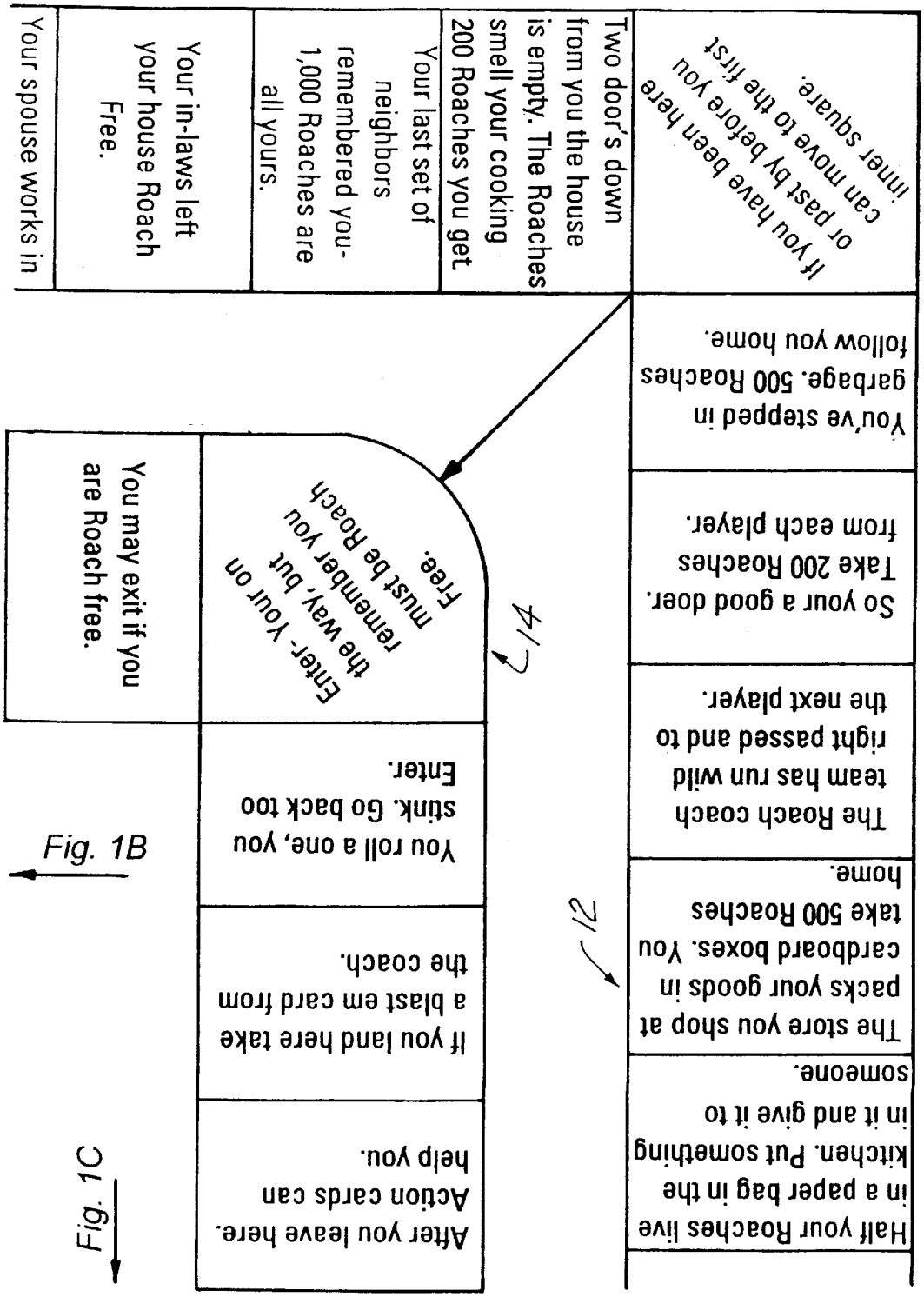
FIG. 1D is a top plan view of the lower right quadrant of the game board shown in FIG. 1.

As can be seen by reference to the drawings, and in particulary to FIG. 1, the game board that forms a part of the present invention is designated generally by the reference number (10). Please note that FIG. 1 is a composite of FIGS. 1A, 1B, 1C and 1D, all of which show a respective quadrant of the game board (10). The game (10) includes a series of forty situation spaces that extend around the outer ring (12) of the essentially rectangular and planar game board (10). At one comer of the outer ring (12) a starting space is provided. The situation spaces in the outer ring (12) include twenty spaces requiring the acquisition of roaches, seven spaces allowing the disposal of roaches, one space requiring the retention of roaches for two plays, seven neutral spaces, three spaces directing player movement to another space, two spaces requiring the player to skip a turn, and one space requiring the player to take a situation card.

An inner ring (14) includes a series of twenty-one situation spaces including three spaces requiring the acquisition of roaches, four spaces allowing the disposal of roaches, eight neutral spaces, three spaces directing player movement to another space, one space requiring the player to take a situation card, and two spaces that disqualify the player. Access to the inner ring (14) from the outer ring (12) is controlled by a situation spaced located at the lower right comer of the game board as shown in FIG. 1.

Figure 2:
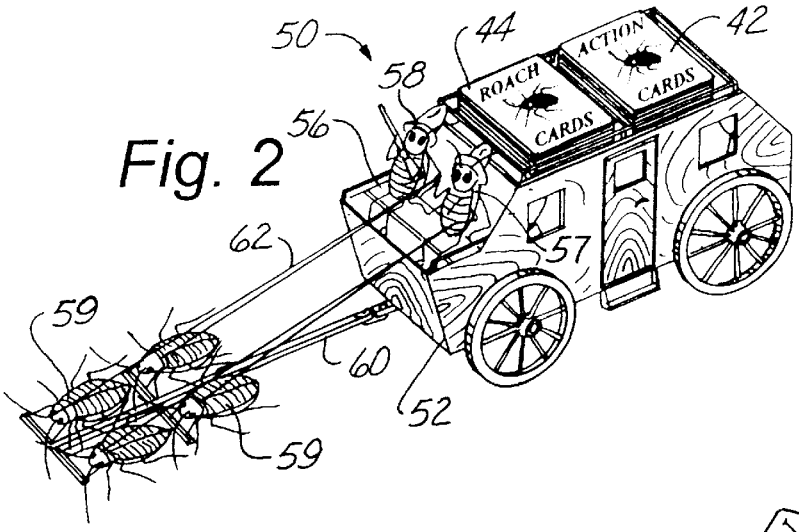
FIG. 2 is a perspective view of the interactive roach coach of the present invention.
Figure 3:
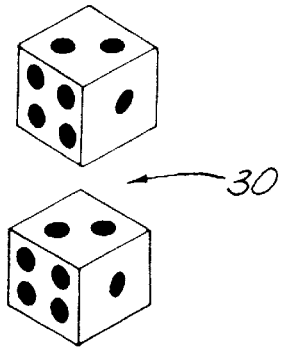
FIG. 3 is a perspective view of the game dice.
Figure 4:
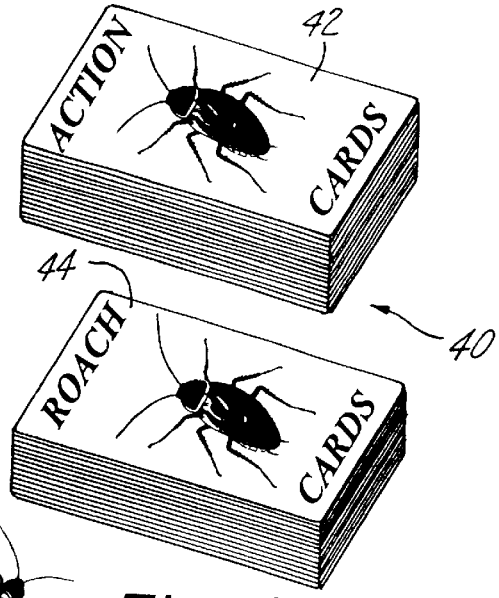
FIG. 4 is a perspective view of the situation cards used in the game.
Figure 5:
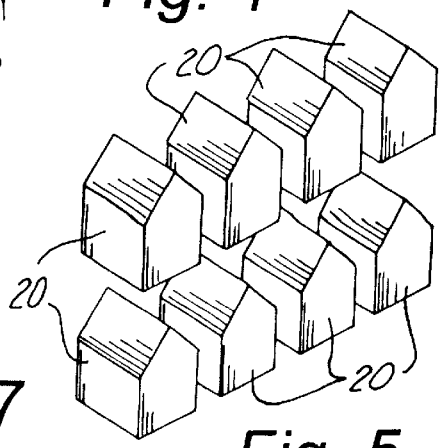
FIG. 5 is a perspective view of the player pieces used in the game.

The game board (10) is used in conjunction with eight game pieces (20) of contrasting colors formed in the shape of houses—each representing a player (FIG. 5); a set of dice (30) each having a box shape with six faces (FIG. 3), the faces of each die bearing dotted indicia from 1 to 6 respectively and with the dice (30) being rollable for controlling movement of the game pieces (20) upon the game board (10); two stacks of situation cards (40) (FIG. 4), one stack of fifty action cards (42) and one stack of fifty roach cards (44); and the interactive game piece holder or roach coach (50) (FIG. 2).

Figure 6:
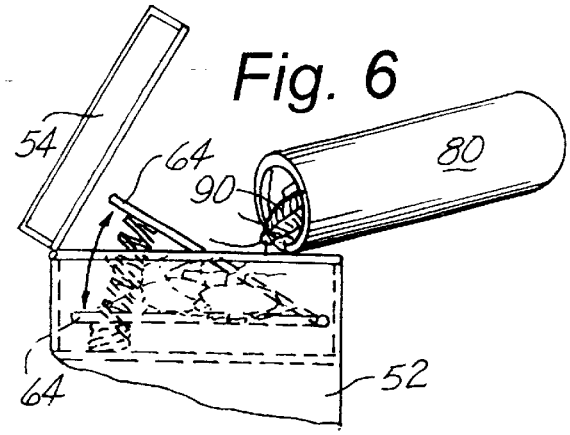
FIG. 6 is a partial side view of the coach showing the hinged roof and the spring biased hinged platform.
Figure 7:
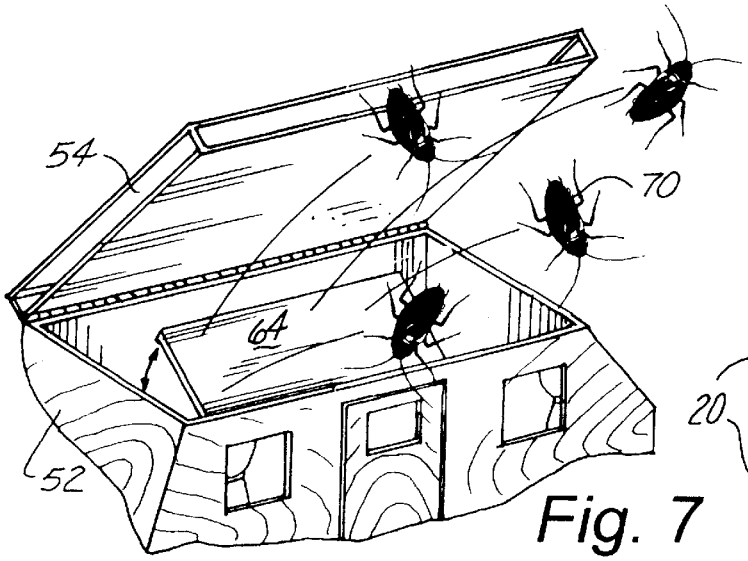
FIG. 7 is a partial perspective view showing roaches being ejected from the coach by the biased platform.

The coach (50) is moved around the game board (10) and it is positioned in front of each respective player when it is their turn to play. As shown in FIGS. 2, 6 and 7, the coach (50) includes a coach body (52) having a hinged roof (54). The upper surface of the roof (54) is sized to hold the two stacks of situation cards (40). A seat (56) is provided at the front of the coach body (52) for a driver roach (57) and a shotgun rider roach (58). Four pulling roaches (59) are attached to the coach body (52) by a tongue (60), and reins (62) extend between the driver roach (57) and the pulling roaches (59). As shown in FIG. 6, a spring biased, hinged platform (64) is positioned below the hinged roof (54).

The action cards (42) include:

8—Stomp 'em—Can only be used against roaches at the time of the draw;

8—Smoke 'em—(Shhh! Don't Tell The Neighbors)—Can be used against the roaches at the time of the draw and against all the roaches you already have; It sends all the roaches to all the neighbors; (Exception—Exempt Card does not have to accept any roaches);

8—Pass 'em—Can be used anytime during your turn except against an Exempt Card;

(If you try to use this card against a player with an Exempt Card, you lose your turn and keep your roaches);

22—Accept 'em—You have no choice. You must accept the roaches on your card;

2—Exterminate 'em—Can be saved or played at players discretion; Kills all of your roaches; Then, player must return the card to the deck;

2—Exempt—Can be played against cards or players one time only; Then, player must return the card to the deck;

(e.g.—You may refuse the Roach Card during your turn and immediately replace the Exempt Card back in the pile immediately or hold it and use it if a player tries to pass you his roaches).

The Roach Cards (44) include:

8—Super Roach—Cannot be stomped or exterminated. It can only be smoked or passed;

20—Iron Plated—Cannot be stomped. It can be passed, smoked or exterminated;

20—Normal—Can get rid of it in any way, providing it is your turn; and

2—You've Been Blasted—Player must lift the coach top.

The "You've been blasted" card means the player must lift the coach roof (54) sideways where spring biased platform (62) is loaded with roaches (70). This springs out at the player who has 5 seconds to pick up the roaches (70) and replace them in the coach (50). The player must keep those roaches (70) that remain on play area. The player must not sweep them up but must pick them up. Once play is over more roaches (70) are added from the roach storage tube (80) to coach (50). So the next player has even more roaches (70) coming at them.

The rules of the game are as follows:

1. Roll the dice to see who goes first. The highest number starts the game off. Then, play continues clockwise until each player has taken their turn.
2. Players draw a card from each of the piles, the Roach Cards (44) and the Action Cards (42).
3. The Roach Card (44) tells the player what type of roaches they will receive and the Action Card (42) tells the player what action they may take.
4. To continue play, after each player has had a turn, everyone rolls gain to see who goes first. Each round is continued the same way.

A player may be disqualified by landing on one of the two disqualifying situation spaces in the inner ring (14), or by having their house game piece (20) infested with 10,000 or more roaches.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

We claim:

1. A board game for two or more competing players, the board game consisting of:

a plurality of player game pieces of contrasting colors each representing a competing player;

a planar rectangular game board including a plurality of situation spaces sequentially arranged around the board, the situation spaces identifying actions to be taken by the player including acquisition of and disposal of roaches;

two dice rollable for controlling movement of the game pieces upon the game board;

two stacks of situation cards, one stack being roach cards identifying the type of roach, and the other stack being action cards identifying actions that the player can or cannot take to dispose of roaches;

a roach coach including a body and a roof pivotally attached to the body, the roof being sized to receive and support the two stacks of situation cards, the roach coach being selectively movable around the game board to a position in front of the players when it is their turn, the roach coach further including a spring biased, hinged platform attached to the coach body below the roof, the platform being movable between a horizontal position and an inclined position, wherein roach members supported on the horizontally disposed platform are ejected from the roach coach onto the game board when the platform moves to the inclined position;

wherein the player game pieces are shaped like houses;

wherein the game board includes an outer ring of situation spaces, an inner ring of situation spaces, and a corner situation space in the outer ring that provides access of a player game piece from the outer ring to the inner ring;

wherein the outer ring includes forty situation spaces, and the inner ring includes twenty-one situation spaces;

wherein the outer ring includes twenty situation spaces requiring the acquisition of roaches, seven situation spaces allowing the disposal of roaches, one situation space requiring the retention of roaches, seven neutral situation spaces, three situation spaces directing movement of a player game piece to another situation space, two spaces requiring a player to skip a turn, and one space requiring a player to take a situation card; and wherein the inner ring includes three situation spaces requiring the acquisition of roaches, four situation spaces allowing the disposal of roaches, eight neutral situation spaces, three situation spaces directing player movement to another situation space, one situation space requiring a player to take a situation card, and two situation spaces that disqualify the player.

* * * * *